United States Patent [19]

Lindberg

[11] B 4,008,972

[45] Feb. 22, 1977

[54] TUBING CONNECTOR

[75] Inventor: Carl E. Lindberg, New Orleans, La.

[73] Assignee: Continental Oil Company, Ponca City, Okla.

[22] Filed: Sept. 30, 1974

[21] Appl. No.: 510,278

[44] Published under the second Trial Voluntary Protest Program on March 30, 1976 as document No. B 510,278.

[52] U.S. Cl. ..... 403/341; 403/360; 403/373

[51] Int. Cl.[2] ..... F16D 1/00

[58] Field of Search ..... 403/341, 344, 360, 361, 403/366, 373, 375, 377, 301, 302, 299, 109, 110, 106, 107; 285/382, 382.2, 373, 419

[56] References Cited

UNITED STATES PATENTS

| | | | |
|---|---|---|---|
| 2,518,243 | 8/1950 | Meyers | 403/360 X |
| 2,557,472 | 6/1951 | Rulon | 403/313 X |
| 2,650,106 | 8/1953 | French | 403/110 X |
| 3,224,800 | 12/1965 | Fisher | 403/118 |
| 3,584,473 | 6/1971 | MacDonald | 403/366 X |

*Primary Examiner*—Andrew V. Kundrat
*Assistant Examiner*—Wayne L. Shedd
*Attorney, Agent, or Firm*—F. Lindsey Scott

[57] ABSTRACT

A connector for joining a tool to a substantially rigid metal tubing, the connector comprising a substantially rigid cylindrical member having an outer diameter smaller than the inside diameter of the metal tubing, a tool fitting attached to one end of the cylindrical member and a tubularly shaped clamp which is maintained in a fixed position relative to the cylindrical member so that when the clamp is tightened, the connector is joined to the metallic tubing.

7 Claims, 5 Drawing Figures

TUBING CONNECTOR

This invention relates to tubing connectors.

This invention further relates to tubing connectors for use in joining tools to tubing.

This invention more particularly relates to tubing connectors for use in oil field operations.

In oil field operations, it is oftentimes desirable to pass a tubing downwardly through a pipe string to flush sand from the pipe string, "fish" lost tools from the pipe string, perforate the pipe string, clean paraffin from the pipe string, descale the pipe string, scrape the inner diameter of the pipe string, and the like. In many instances, it is desirable that the tubing include a tool mounted at its end to facilitate the removal of material from the pipe string and the like. It has heretofore been common practice to flare an end of the tubing and thus join a tool to the tubing by use of a fitting which joins the flared portion of the tubing to the tool or a tool joint. Threaded connections have also been used to join the tubing to the tool or tool joint. Both flaring and threading the tubing tend to result in thin sections in the tubing wall at the threads or flares. These thin sections are normally the thinnest sections of the tubing and fatigue or stress failures frequently occur at the flare or threads. Quite obviously, the tool portion of the tubing assembly remains in the pipe string when such failures occur and is difficult to recover. As a result, a continuing effort has been directed to the development of better methods for joining tubing to tools. It has now been found that an improved connection is achieved by the use of a connector for joining a tool to a substantially rigid metal tubing, wherein the connector comprises a substantially rigid cylindrical member having an outer diameter smaller than the inside diameter of the metal tubing; a tool joint axially attached to one end of the cylindrical member; an elongated substantially tubular shaped clamp means having means along its length for changing the inner diameter of the clamp means; and means for connecting the clamp means to the cylindrical member to prevent axial movement of the clamp means relative to the cylindrical member.

Figure 1:
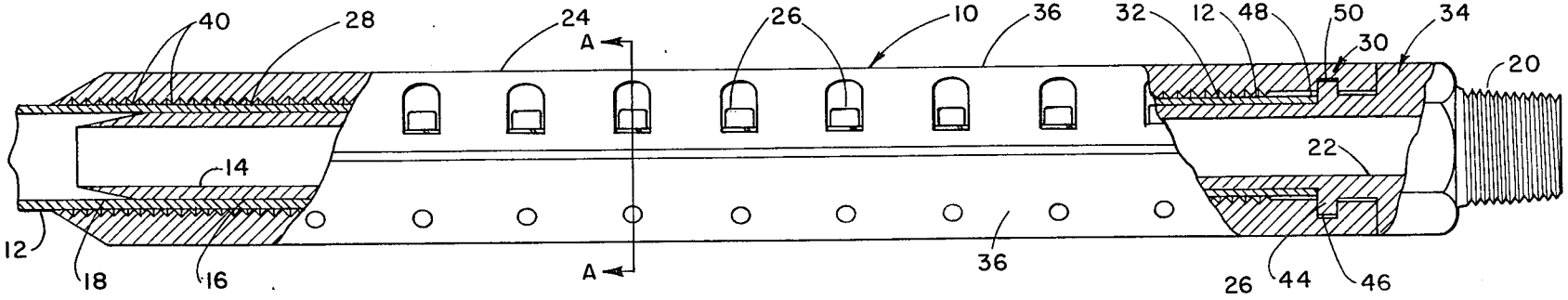
FIG. 1 is a partial cross-sectional view of an embodiment of the connector of the present invention.
Figure 4:
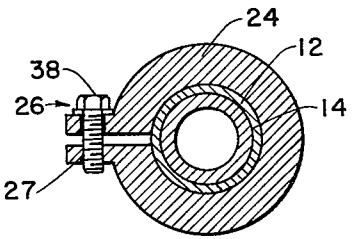
FIG. 4 is a cross-sectional view of a further embodiment of a clamp means.
Figure 2:
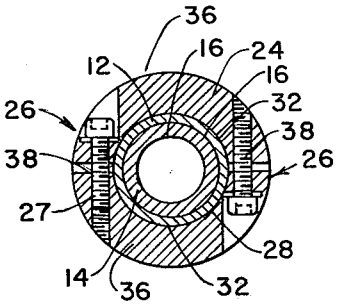
FIG. 2 is a cross-sectional view of the connector of FIG. 1 taken at Section AA with the bolts in full view.

With reference to all of the figures and FIG. 1 in particular, a connector 10 for joining a tool, not shown, to a substantially rigid metallic tubing 12 is shown. Connector 10 comprises a substantially rigid cylindrical member 14 which has an outer diameter 16 smaller than the inside diameter 18 of metal tubing 12 to permit insertion of cylindrical member 14 inside tubing 12 but large enough that outer diameter 16 closely joins inside diameter 18. Clearly, outer diameter 16 is only slightly smaller than inner diameter 18 as required to permit the insertion of cylindrical member 14 into metal tubing 12. A tool joining means 20 is positioned on one end 22 of cylidrical member 14. Tool joining means 20 is shown as a threaded fitting, although clearly other means for joining cylindrical member 14 to a tool could be used. Connector 10 also includes an elongated substantially tubularly shaped clamp means 24 which includes means 26 along its length for changing its inner diameter 28. As shown in FIG. 2 and FIG. 4, a preferred means 26 comprises bolts 38 for changing inner diameter 28 of clamp means 24. Clamp means 24 includes means 30 for securing clamp means 24 to cylindrical member 14 to prevent movement of clamp means 24 with respect to cylindrical member 14.

FIG. 2 shows clamp means 24 as two sections 36 which are positioned around outer diameter 32 of tubing 12. Means 26 for changing inner diameter 28 of clamp means 24 comprises a pair of bolts 38 with threads 27 positioned to mate with bolts 38. Desirably, a plurality of means 26 is positioned along the length of clamp 24 as shown in FIG. 1. The number of means 26 used will vary dependent upon the length of clamp 24, the type of means 26 chosen, the tool joined to connector 10, and the like.

Figure 3:
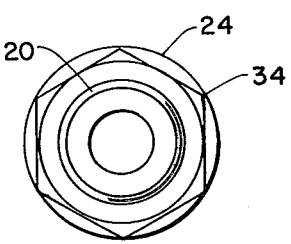
FIG. 3 is an end view of the connector of FIG. 1.

In FIG. 3, an end view of connector 10 fo FIG. 1 is shown. It has been found desirable that a shoulder 34 be positioned between tool joining means 20 and an end 48 of tubing 12. Shoulder 34 is desirably shaped to facilitate the joining of tool joint 20 with a tool and the like. It has further been found that shoulder 34 facilitates the snug makeup of the tool joint and the like. Clearly, connector 10 could be fabricated and used without shoulder 34, although as noted, it has been found desirable that shoulder 34 be included.

FIG. 4 shows an alternate clamping device. One bolt 38 with mating threads 27 is used to change inner diameter 28 of clamp means 24.

Figure 5:
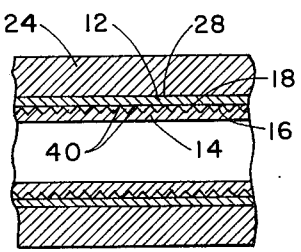
FIG. 5 is a sectional view showing a further embodiment of the connector of FIG. 1.

It is desirable that tooth means 40 be positioned on inner diameter 28 of clamp means 24. It has also been found desirable to position tooth means 40 on outer diameter 16 of cylindrical member 14, as shown in FIG. 5. Clearly, teeth 40 can be used on either or both surfaces, and of course, teeth 40 can take a variety of configurations varying from knurling to relatively sharp projections. It is preferred, however, that teeth 40 be of a size such that penetration of teeth 40 into metal tubing 12 is kept to a minimum consistent with the accomplishment of a gripping contact between metal tubing 12 and cylindrical member 14 and clamp means 24.

In the embodiment shown in FIG. 1, means 30 for securing clamp means 24 to cylindrical member 14 comprises a cylindrical projection 44 having an outer diameter 46 greater than outer diameter 32 of tubing 12. A mating receptacle 50 is positioned in clamp means 24 so that the union of receptacle means 50 and cylindrical projection 44 results in connecting clamp means 24 to cylindrical member 14 so that movement of clamp means 24 with respect to cylindrical member 14 is restricted. Obviously, other means for joining clamp means 24 and cylindrical member 14 are suitable, as is well known to those skilled in the art.

In the use of the connector of the present invention, cylindrical member 14 is positioned inside metal tubing 12 so that end 48 of metal tubing 12 closely joins cylindrical projection 44. Clamp means 24 is positioned around outer diameter 32 of tubing 12 and tightened so that inner diameter 28 of clamp means 24 is urged into gripping contact with outer diameter 32 of tubing 12, thus, urging inner diameter 18 of tubing 12 into close contact with outer diameter 16 of cylindrical member 14. Connector 10 is thus tightly joined to metal tubing 12. Clearly, the use of teeth 40 on outer diameter 16 of cylindrical member 14 and inner diameter 28 of clamp means 24 results in a stronger union of connector 10 and metal tubing 12. It is not necessary that teeth 40 be included on both surfaces, and it is preferred teeth 40 be positioned on inner diameter 28 of clamp means 24 when teeth 40 are used on only one surface. The use of teeth 40 on outer diameter 16 while desirable for gripping purposes tends to make the positioning of cylindrical member 14 inside tubing 12 more difficult. When teeth 40 are positioned on diameter 16, it is desirable that teeth 40 be positioned in a spiral arrangement and the like to facilitate positioning cylindrical member 14 in tubing 12. It is to be clearly understood that the use of the connector of the present invention is effective without teeth 40 on either of the surfaces, although it is preferred that teeth 40 be used on inner diameter 28. A suitable tool is then joined to tool joining means 20 by conventional techniques.

In a preferred embodiment of the present invention, clamp means 24 is substantially the same length as cylindrical member 14 so that the ends of cylindrical member 14 and clamp means 24 furthest from tool joining means 20 substantially coincide. The bending stresses and the like in tubing 12 thus occur in a section of tubing 12 which has the full tubing wall thickness. In the use of connector 10 of the present invention, it is contemplated that after a tubing job using connector 10, connector 10 can be readily disassembled and tubing 12 cut off at a point above the end of cylindrical member 14, thus replacing the section of tubing 12 which has been subjected to bending stress and the like. It is thus seen that a reliable connection between a tool and metal tubing 12 is achieved by the use of the connector of the present invention.

In the event that tubing 12 should fail above connector 10, connector 10 provides a projection above the tool which facilitates "fishing" operations. Clearly clamp 24 and cylindrical member 14 provide a projection which is more easily recovered than a tool alone. Clamp 24 and cylindrical member 14 may be of any suitable length, although it is preferred that they be of a length equal to at least three times outer diameter 32 of tubing 12.

The connector of the present invention can be prepared from materials commonly used for the fabrication of oil field tools, such as mild steel, heat-treated steel, and the like. Any such materials will be found suitable so long as they provide adequate structural strength and chemical resistance to the environments in the well bore wherein the tubing connector is used.

It should be understood that the foregoing description of preferred embodiments is illustrative rather than limiting in nature and that many variations and modifications are possible within the scope of the present invention. Such variations and modifications may be obvious or desirable to those skilled in the art upon a review of the foregoing description of preferred embodiments.

Having thus described the invention, I claim:

1. A connector for joining a tool to a substantially rigid metallic tubing, said connector comprising:

a. a substantially rigid tubular member, having an outer diameter smaller than the inside diameter of said metallic tubing, said tubular member being positioned inside said metallic tubing with said outer diameter of said tubular member being in slidable contact with the inside diameter of said metallic tubing;

b. a tool joining means axially attached to one end said tubular member said one end extending beyond an end of said metallic tubing;

c. an elongated substantially tubularly shaped clamp means having means along its length for urging the inner diameter of said clamp means into gripping contact with the outer diameter of said metallic tubing and urging said inner diameter of said metallic tubing into contact with said outer diameter of said tubular member; and d. means for connecting said clamp means to said one end of said tubular member to prevent axial movement of said clamp means with respect to said metallic tubing and said tubular member so that when said inner diameter of said clamp means is urged into gripping contact with said outer diameter of said metallic tubing and said inner diameter of said metallic tubing is urged into contact with said outer diameter of said tubular member thus joining said connector to said tubing.

2. The connector of claim 1 wherein said clamp means comprises at least two sections.

3. The connector of claim 2 wherein said inner surface of said clamp means includes teeth means.

4. The connector of claim 1 wherein said cylindrical member and said clamp means are of a length equal to at least three times said outer diameter of said tubing.

5. The connector of claim 1 wherein said means for connecting said clamp means to said cylindrical member comprises a cylindrical projection means axially positioned on said cylindrical member, said projection means having an outer diameter greater than the outer diameter of said tubing and being positioned between an end of said tubing and said tool joining means and a receptacle means on said clamp means for mating junction with said projection means.

6. The connector of claim 1 wherein said means for changing the inner diameter of said clamp means comprises a plurality of bolt means positioned along said clamp means.

7. The connector of claim 1 wherein said outer diameter of said cylindrical member includes teeth means.

* * * * *